US007805903B2

(12) United States Patent
Liu

(10) Patent No.: US 7,805,903 B2
(45) Date of Patent: Oct. 5, 2010

(54) LOCKING MECHANISM FOR FLOORING BOARDS

(76) Inventor: David C. Liu, 2298 Edgemere Lake Ct., Marietta, GA (US) 30062

( * ) Notice: Subject to any disclaimer, the term of this patent is extended or adjusted under 35 U.S.C. 154(b) by 382 days.

(21) Appl. No.: 11/956,057

(22) Filed: Dec. 13, 2007

(65) Prior Publication Data

US 2009/0151290 A1 Jun. 18, 2009

(51) Int. Cl.
*E04B 2/00* (2006.01)

(52) U.S. Cl. ..... 52/489.1; 52/586.1

(58) Field of Classification Search ..... 52/390, 52/392, 533, 534, 539, 553, 578, 582.1, 586.1, 52/586.2, 588.1, 589.1, 590.2, 590.3, 591.1, 52/591.2, 591.3, 571.4, 591.5, 592.1, 592.2, 52/592.4, 745.08, 745.19, 747.1, 747.11, 52/748.1, 748.11, 489.1, 489.2, 460, 468, 52/470, 471, 472, 393, 395, 585.1
See application file for complete search history.

(56) References Cited

U.S. PATENT DOCUMENTS

| | | | | |
|---|---|---|---|---|
| 3,363,383 | A * | 1/1968 | La Barge | 52/471 |
| 3,665,666 | A * | 5/1972 | Delcroix | 52/461 |
| 3,775,921 | A * | 12/1973 | Avera | 52/471 |
| 4,435,935 | A * | 3/1984 | Larrea | 52/461 |
| 5,655,346 | A * | 8/1997 | Holmes et al. | 52/476 |
| 5,806,261 | A * | 9/1998 | Huebner et al. | 52/283 |
| 5,860,267 | A | 1/1999 | Pervan | |
| 6,253,514 | B1 * | 7/2001 | Jobe et al. | 52/471 |
| 6,449,918 | B1 | 9/2002 | Nelson | |
| 6,532,709 | B2 | 3/2003 | Pervan | |
| 6,763,643 | B1 * | 7/2004 | Mårtensson | 52/586.1 |
| 6,860,074 | B2 * | 3/2005 | Stanchfield | 52/464 |
| 6,922,964 | B2 | 8/2005 | Pervan | |
| 6,966,161 | B2 * | 11/2005 | Palsson et al. | 52/589.1 |
| 7,051,486 | B2 | 5/2006 | Pervan | |
| 7,251,916 | B2 | 8/2007 | Konzelmann | |

(Continued)

FOREIGN PATENT DOCUMENTS

| | | | |
|---|---|---|---|
| GB | 2433749 | A | 7/2007 |

(Continued)

OTHER PUBLICATIONS

International Search Report and Written Opinion issued on Jul. 8, 2009, for the corresponding PCT application.

*Primary Examiner*—Richard E Chilcot, Jr.
*Assistant Examiner*—Alp Akbasli
(74) *Attorney, Agent, or Firm*—Wang Law Firm; Li K. Wang

(57) ABSTRACT

A locking system for floor boards comprises a plurality of floor boards and a plurality of locking devices. Each floor board has two tongues on one lateral side and another tongue and a locking groove on the opposite lateral side. The floor board also has two grooves on its bottom side. The locking device has three protruding gripping extensions. Few locking devices are placed on each floor board before the floor boards are sent to a job site. At the job site, two adjacent floor boards are assembled together by inserting the tongue of one board into a space defined by the locking device and the tongues of the adjacent board. The tongues are further secured in place by compression of flexible buffers located at each protruding gripping extension.

10 Claims, 8 Drawing Sheets

U.S. PATENT DOCUMENTS

| | | | | |
|---|---|---|---|---|
| 7,409,802 | B2 * | 8/2008 | Fiedler | 52/466 |
| 2003/0024199 | A1 * | 2/2003 | Pervan et al. | 52/589.1 |
| 2004/0182036 | A1 * | 9/2004 | Sjoberg et al. | 52/592.1 |
| 2004/0211143 | A1 * | 10/2004 | Hanning | 52/578 |
| 2007/0151189 | A1 * | 7/2007 | Yang | 52/582.2 |

FOREIGN PATENT DOCUMENTS

| | | | |
|---|---|---|---|
| JP | 03515075 | B2 | 4/2004 |
| KR | 10-2005-0002919 | A | 1/2005 |

* cited by examiner

LOCKING MECHANISM FOR FLOORING BOARDS

FIELD OF THE INVENTION

The invention relates to wood flooring, and more particularly, to a locking mechanism for flooring boards.

BACKGROUND OF THE INVENTION

Different systems have been used to ease construction of wood flooring; however, most of them present some deficiency especially in relation to engaging thin laminate "floating floor" surfaces. Traditional wood floors, which are joined by means of glued tongue-and-groove joints, wood floor panels have recently been developed which do not require the use of glue and instead are joined mechanically by means of so-called mechanical joint systems. These systems contain locking means which lock the panels horizontally and vertically. Typically, manufacturers of laminate flooring panels have produced flooring products that contain both a tongue and a groove profile within the same flooring panel. The tongue profile is machined into one side and one end of the panel with the groove being machined into the opposite side and end of the same panel. The mechanical joint systems can be made by machining the core of a panel. One exemplary locking device is disclosed by U.S. Pat. No. 6,532,709 B2. Alternatively, parts of the locking system can be made of a separate material which is integrated with the floor panel, i.e. joined with the floor panel even in connection with the production thereof.

Besides the locking means provided by the flooring panels, the adjacent panels are further secured by locking devices. The locking device typically is a strip with salient features that engages the locking device onto two adjacent flooring panels. One exemplary locking device is disclosed by the same U.S. patent cited above.

Normally, one or more locking devices are affixed first onto a floor panel and the tongue of a second flooring panel is inserted into the groove of a second flooring panel. The second flooring panel is further secured in its place by the locking device. The insertion of the tongue in the groove forms a lock.

However, the lock between two adjacent flooring panels sometime becomes "loose," allowing some movement between the two flooring panels. The movement between the adjacent flooring panels generates squeaking sound and it is hard to eliminate. The lock also requires precision milling for the lock works properly and small deformation of flooring panel after milling will render the lock and locking device unusable.

Therefore, there is a need for an apparatus that reduces relative movement between two adjacent flooring boards and simplifies flooring board manufacturing process, and it is to this apparatus the present invention is primarily directed to.

SUMMARY OF THE INVENTION

The present invention provides an improved locking mechanism for joining floor boards. Each floor board is provided with a special profile that does not require precision milling and adjacent floor boards are joined by fitting them together thought the special profile and with use of a locking device. In one embodiment of the invention, there is provided a locking system for floor boards. The locking system comprises a plurality of floor boards and a plurality of locking devices. Each floor board has a top side, a bottom side, a first short side, a second short side, a first long side, and a second long side, each long side has a length. The first long side has a first tongue and a second tongue along the length of the first long side, the first tongue being defined by a first upper abutment surface and a first lower abutment surface, the second tongue being defined by a second upper abutment surface and a second lower abutment surface. The second long side has a third tongue and a first locking groove along the length of the second long side, the third tongue being defined by a third upper abutment surface and a third lower abutment surface, the first locking groove being defined by a first upper groove surface and the third upper abutment surface. Each locking device has a base, a first protruding gripping extension located at a first end of the base, a second protruding gripping extension located at a second end of the base, and a third protruding gripping extension located between the first and second gripping extensions. The first protruding gripping extension further has a first receiving groove and a first buffer inserted in the first receiving groove and facing the third protruding gripping extension. The second protruding gripping extension has a first side facing the third protruding gripping extension and a second side opposite of the first side, the second protruding gripping extension further having a second receiving groove on the first side and a second buffer inserted in the second receiving groove, the second side having a tooth. Adjacent floor boards are joined and locked by inserting the third tongue of a first floor board into a groove defined by the first protruding gripping extension and the third protruding gripping extension and inserting the first tongue of a second floor board into the first locking groove of the first floor board and the second tongue of the second floor board into a groove defined by the second protruding gripping extension and the third protruding gripping extension.

In another embodiment of the invention there is provided a floor board. The floor board has a top side, a bottom side, a first short side, a second short side opposite of the first short side, a first long side, and a second long side opposite of the first long side. Each long side has a length, and the first long side has a first tongue and a second tongue along the length of the first long side. The first tongue is defined by a first upper abutment surface substantially parallel to the top side and a first lower abutment surface substantially parallel to the first upper abutment surface, and the second tongue is defined by a second upper abutment surface substantially parallel to the top side and a second lower abutment surface substantially parallel to the second upper abutment surface. The second long side has a third tongue and a first locking groove along the length of the second long side. The third tongue is defined by a third upper abutment surface substantially parallel to the top side and a third lower abutment surface substantially parallel to the third upper abutment surface. The first locking groove is defined by a first upper groove surface substantially parallel to the top side and the third upper abutment surface.

In yet another embodiment of the invention there is also provided a locking device for floor boards. The locking device has a base with a first end and a second end, a first protruding gripping extension located at the first end of the base, a second protruding gripping extension located at the second end of the base, and a third protruding gripping extension located between the first and second gripping extensions. The first protruding gripping extension further has a first receiving groove and a first buffer removably inserted in the first receiving groove and facing the third protruding gripping extension, and the second protruding gripping extension has a first side facing the third protruding gripping extension and a second side opposite of the first side. The second protruding gripping extension further has a second receiving groove on the first side and a second buffer removably inserted in the second receiving groove, the second side having a tooth.

BRIEF DESCRIPTION OF THE DRAWINGS

Features and advantages of embodiments of the invention will become apparent as the following Detailed Description proceeds, and upon reference to the Drawings, where like numerals depict like elements, and in which.

DETAILED DESCRIPTION OF THE INVENTION

Figure 1A:
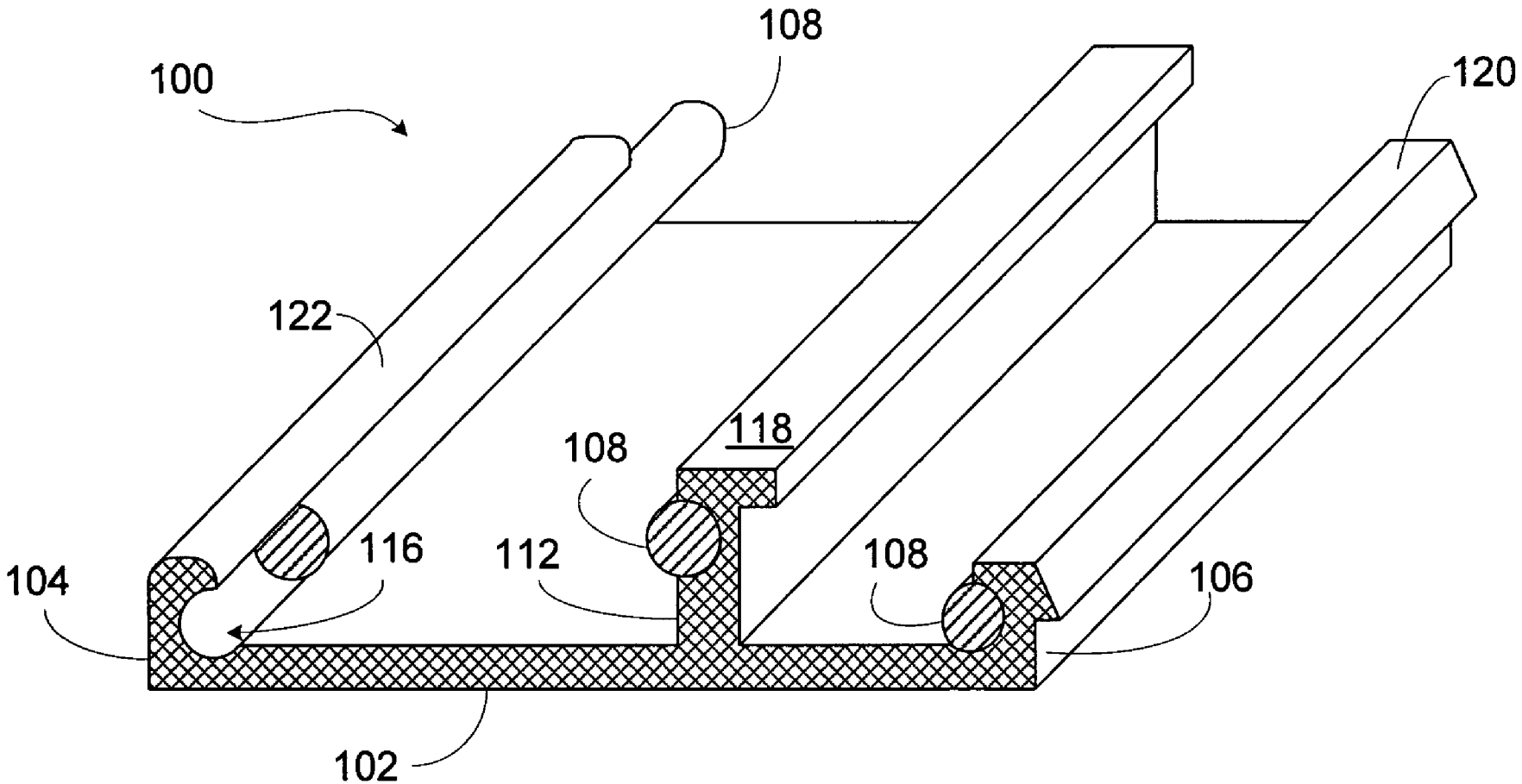
FIG. 1A illustrates a perspective view of a locking device according to one embodiment of the invention.
Figure 1B:
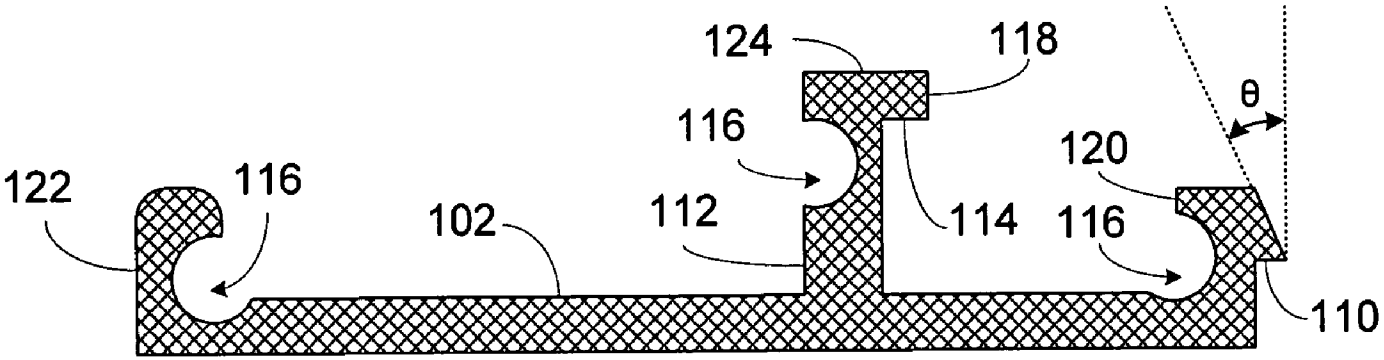
FIG. 1B illustrates a profile of the locking device shown in FIG. 1A.

The present invention provides a locking system for floor boards. Floor board may be made from solid wood or composite wooden material with several layers or other suitable material. Each floor board has a profile with specially designed features that allow one floor board be easily joined with an adjacent floor board. The joined floor boards are further locked together with locking devices strategically distributed along the seam of two joined floor boards. FIG. 1A illustrates one embodiment of a locking device 100 and FIG. 1B illustrates a profile of the locking device 100. The locking device 100 is preferably made from a resilient and flexible material, such as steel, aluminum, plastic, rubber, etc. The locking device 100 has a base 102 with a first end 104 and a second end 106. A first protruding gripping extension 122 is located at the first end 104 and a second protruding gripping extension 120 is located at the second end 106. The top of the first protruding gripping extension 122 is preferably rounded, or alternatively having the edge facing the second protruding gripping extension 120 rounded. A receiving groove 116 is preferably formed on the first protruding gripping extension 122 or at the junction of the first protruding gripping extension 122 and the base 102. The receiving groove 116 is formed in such way that a flexible buffer 108 can be inserted therein. The flexible buffer 108 has preferably a round shape, but other shapes may also be used. The flexible buffer 108 is preferably made from rubber or plastic, or other suitable material. The flexible buffer 108 can be, preferably, slid into and out from the receiving groove 116. However, flexible buffer 108 may also otherwise be jammed into the receiving groove 116.

The second protruding gripping extension 120 has a top that extends beyond the second protruding gripping extension 120. The top has a trapezoidal form with the top part being slightly smaller than the bottom part and an angle θ formed between a vertical plan touching the corner of the bottom part and one side of the trapezoidal form. The angle θ helps to form a tooth 110 on the top of the second protruding gripping extension 120. Similar to the first protruding gripping extension 122, the second protruding gripping extension 120 may also have a receiving groove 116 in which a flexible buffer 108 may be inserted.

Optionally, the locking device 100 has also a third protruding gripping extension 112 located between the first protruding gripping extension 122 and the second protruding gripping extension 120. The third protruding gripping extension 112 has a horizontal platform 118 that extends beyond the third protruding gripping extension 112. The horizontal platform 118 has a lower abutment surface 114 and a top surface 124. Alternatively, the horizontal platform 118 may have a trapezoidal profile similar to that of the tooth 110. The profile of a locking device 100 without the third protruding gripping extension 112 is shown in FIG. 6C. Optionally, the third protruding gripping extension 112 has a receiving groove 116 in which a flexible buffer 108 may be inserted. The profile of a locking device 100 without the third protruding gripping extension 112 and without the flexible buffer 108 is shown in FIG. 6B.

Figure 2A:
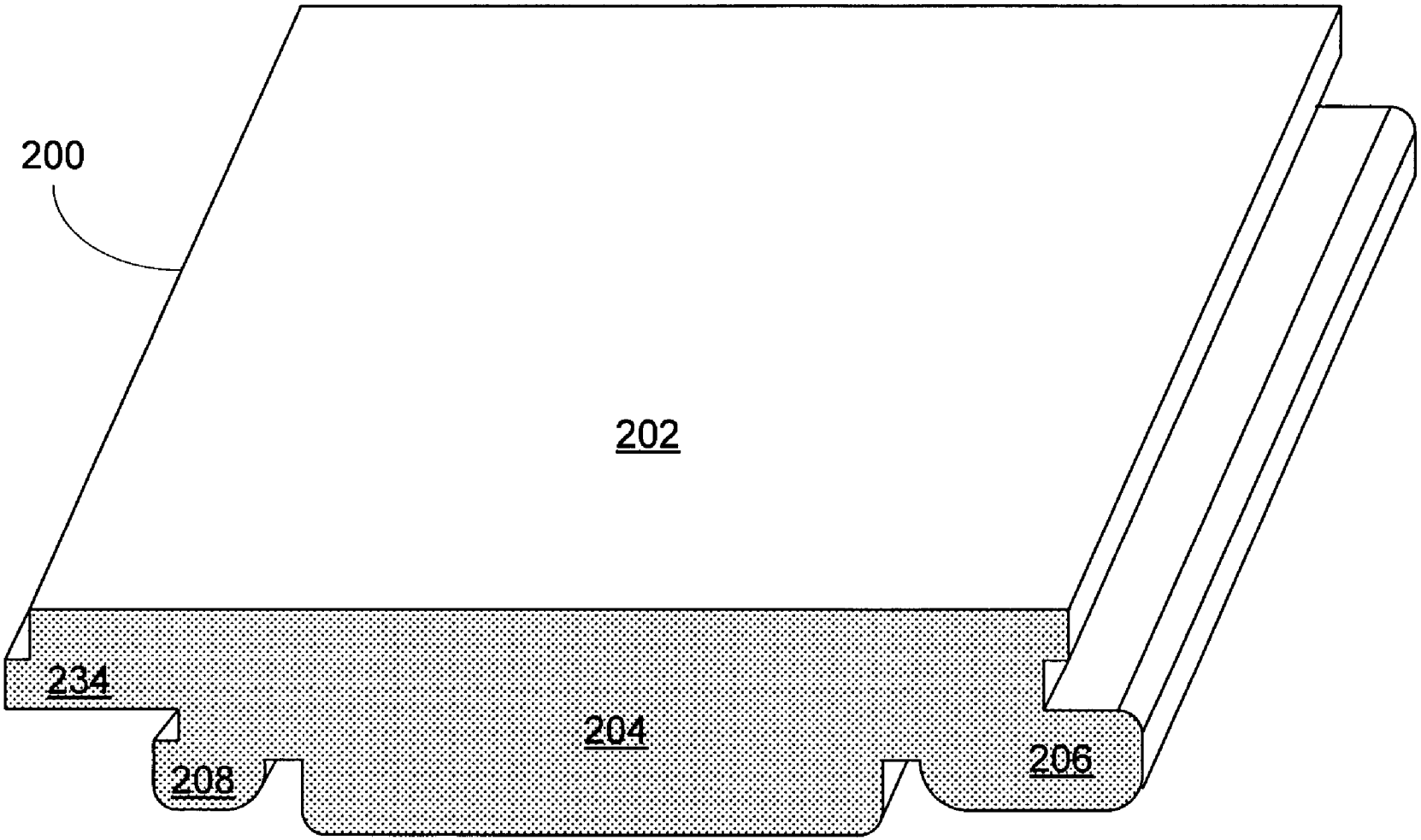
FIG. 2A illustrates a perspective view of a floor board according to one embodiment of the invention.
Figure 2B:
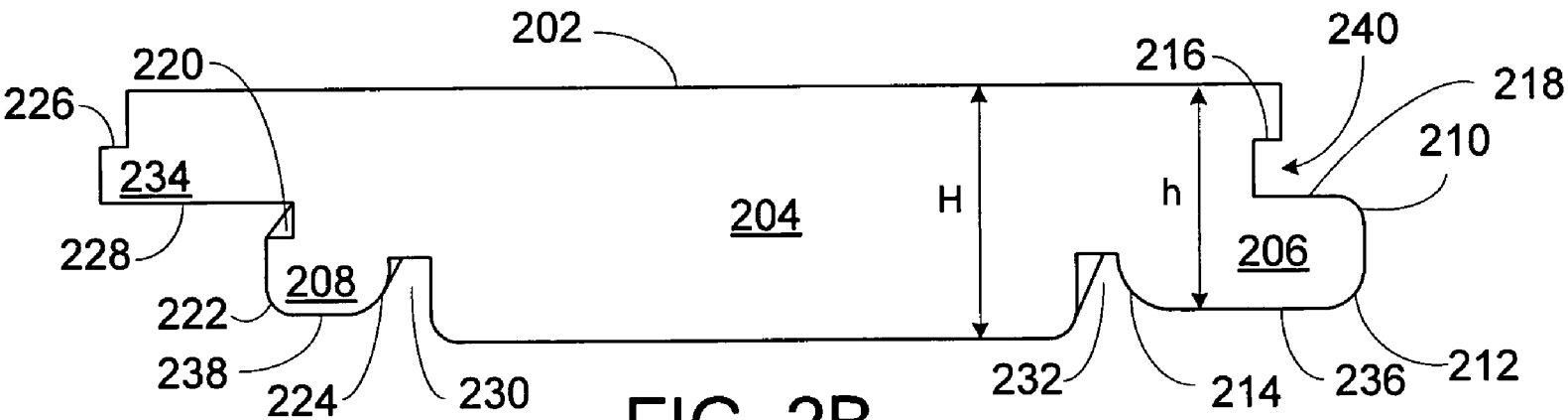
FIG. 2B illustrates the profile of a floor board according to one embodiment of the invention.

FIG. 2A is a perspective view of a floor board 200 according to one embodiment of the invention and FIG. 2B is a profile of the floor board 200. The floor board 200 may be made from solid wood, a manufactured multi-layer wood material, or a composite synthetic-wood material. The floor board 200 has a wooden top surface 202, two tongues 234, 208 along the length of one lateral side, and another tongue 206 along the length of an opposite lateral side. These tongues are reflected by the profile 204.

The tongue 234 is formed by an upper abutment surface 226 and a lower abutment surface 228 and the tongue 208 is defined by another upper abutment surface 220 and another lower abutment surface 238. The upper abutment surfaces 226 and 220, lower abutment surfaces 228 and 238 are substantially parallel to the top surface 202. The lower two corners 222, 224 of the tongue 208 is preferably rounded. Optionally, the tongue 234 may be covered with a coating of rubber, plastic, thin film, or other suitable material that minimize friction.

On the opposite side of the tongue 234, there is a locking groove 240 for receiving the tongue 234 from an adjacent floorboard. The locking groove 240 is defined by an upper groove surface 216 and an upper abutment surface 218. The upper groove surface 216 is substantially lined up with the upper abutment surface 226 and the upper abutment surface 218 is substantially lined up with the lower abutment surface 228. There is a tongue 206 below the locking groove 240. The tongue 206 is defined by the upper abutment surface 218 and a lower abutment surface 236. Three corners 210, 212, and 214 of the tongue 206 are preferably rounded. The bottom of the floor board 200 has two locking grooves 230, 232 for receiving the second protruding gripping extension 120 and the first protruding gripping extension 122 respectively when two adjacent floor board 200 are joined using a locking device 100.

The thickness H of the profile 204 is slightly larger than thickness h, thus a locking device 100 can be placed beneath the joined floor boards 200 without raising the high of the final floor boards. Optionally, the thickness H and thickness h can be the same or similar, thus the bottom of the floor boards 200 floats above the underlayment. Preferably, the lower abutment surface 238 is substantially lined up with the lower abutment surface 236. However, because of use of multiple tongues 206, 208, 234, and the locking device 100, the present invention eliminates high precision milling commonly used in the manufacturing of floor boards 200, thus reduces the manufacturing cost of floor boards 200.

Figure 3:
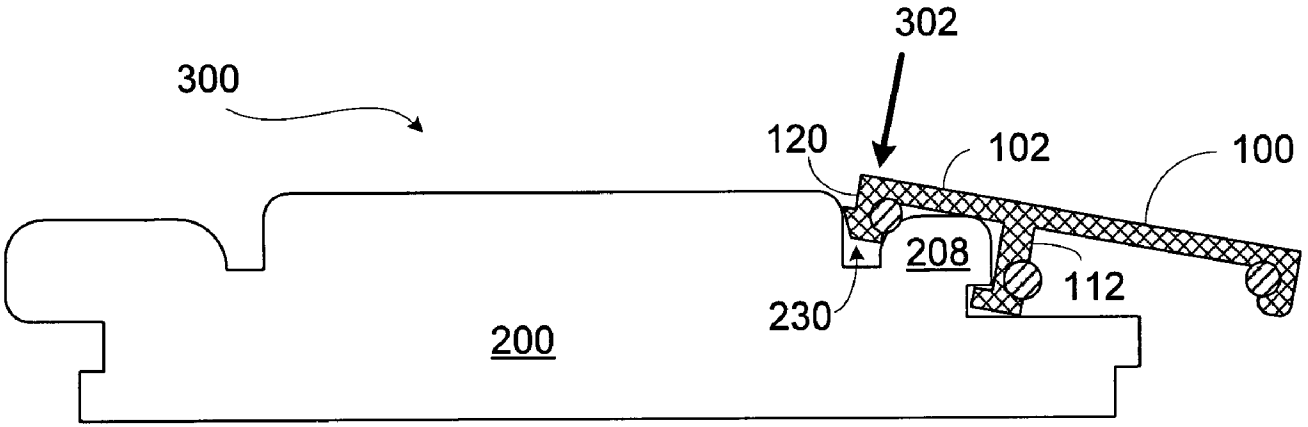
FIG. 3 illustrates a locking device prior being attached to a floor board on a job site according to one embodiment of the invention.

Preferably, few locking devices 100 are placed on each floor board 200 prior the floor boards 200 are shipped to a job site. There is no need to cover entirely either lateral side of a floor board with a long locking device as required by prior art floor boards and locking devices. When the floor boards 200 arrive at the job site, installers can easily assemble the floor boards 200 together. As it would normally happen, the floor boards may need to be cut at the job site and additional locking devices 100 may need to be fixed onto a floor board 200. FIG. 3 depicts a locking device 100 prior to be fixed onto a floor board 200. The tongue 208 is slid into a groove defined by the base 102, the second protruding gripping extension 120, and the third protruding gripping extension 112. The width of the second protruding gripping extension 120 along with the tooth 110 is preferably slightly wider than the width of the locking groove 230 such that the second protruding gripping extension 120 cannot be inserted into the locking groove 230 without application of an external force 302.

Figure 4:
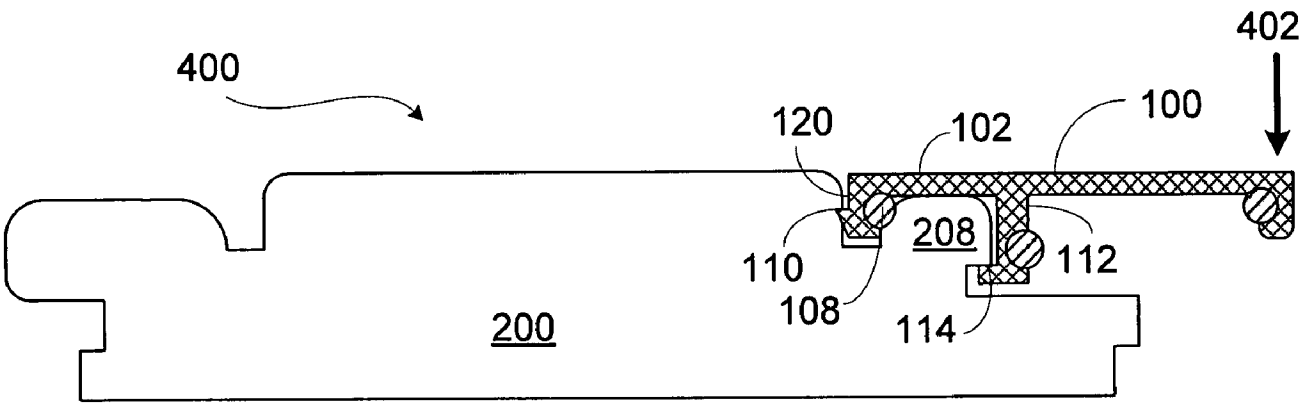
FIG. 4 illustrates a locking device after being attached to a floor board on a job site according to one embodiment of the invention.

After applying the external force 302, for example, by hammering, the second protruding gripping extension 120 of the locking device 100 can be forced into the locking groove 230 and the second protruding gripping extension 120 is prevented from detaching from the locking groove 230 by the tooth 110 that is jammed into the surface of the locking groove 230 as it is shown in FIG. 4. The tongue 208 is locked into the position by the base 102 and lower abutment surface 114 of the third protruding gripping extension 112. The tongue 208 is also secured by compression against the flexible buffer 108. Minor imperfections of the tongue 208 can be easily compensated by locking provided by the base 102 and the lower abutment surface 114 and compression by the flexible buffer 108 along the length of the locking device 100. The locking device 100 can also be removed on a job site if needed. To remove a locking device 100 simply apply a large force 402 at the locking device 100 as shown in FIG. 4. The removed locking device 100 can be re-installed at different location on the same floor board 200.

Figure 5:
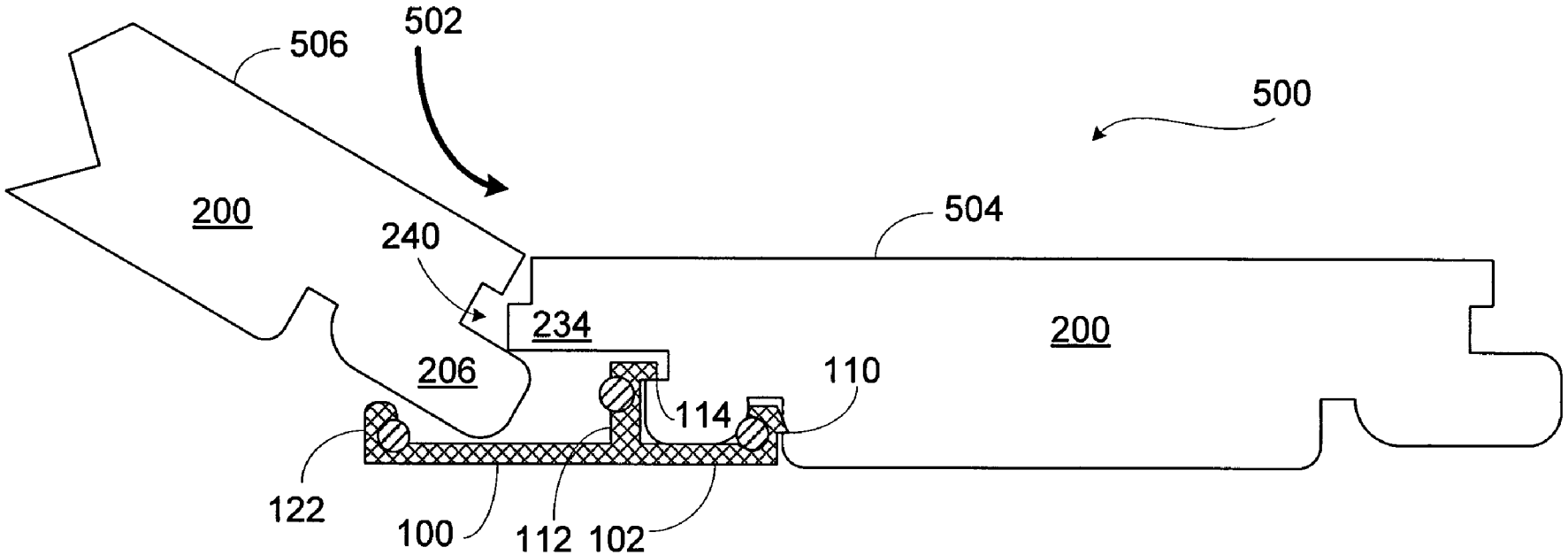
FIG. 5 illustrates assembly of two adjacent floor boards.

FIG. 5 illustrates assembly 500 of two adjacent floor boards 200. A first floor board 504 has a locking device 100 attached. The tongue 206 of a second floor board 506 is inserted into a groove defined by the first protruding gripping extension 122, the base 102 of the locking device 100, the third protruding gripping extension 112, and the tongue 234 of the first floor board 504. Because the lower corners of the tongue 206 and the top of the first protruding gripping extension 122 are rounded, the insertion in the direction 502 is made easier. As the tongue 206 of the second floor board 506 is slid into the above described groove, the tongue 234 of the first floor board 504 is also slid into the locking groove 240 of the second floor board 506. The fitting of the tongue 234 into the locking groove 240 provides a precise fitting between two adjacent floor boards 200 and also levels two adjacent floor boards 200. If the tongue 234 has a coating or covered with a film, the friction noise between two adjacent floor boards 234 will be further reduced. It is understood by those skill in the art that the tongue 234 and the corresponding locking groove 240 may have different shapes. One example of a different shape is the abutment surfaces between the tongue 234 and the locking groove 240 are not parallel to the top surface 202.

Figure 6A:
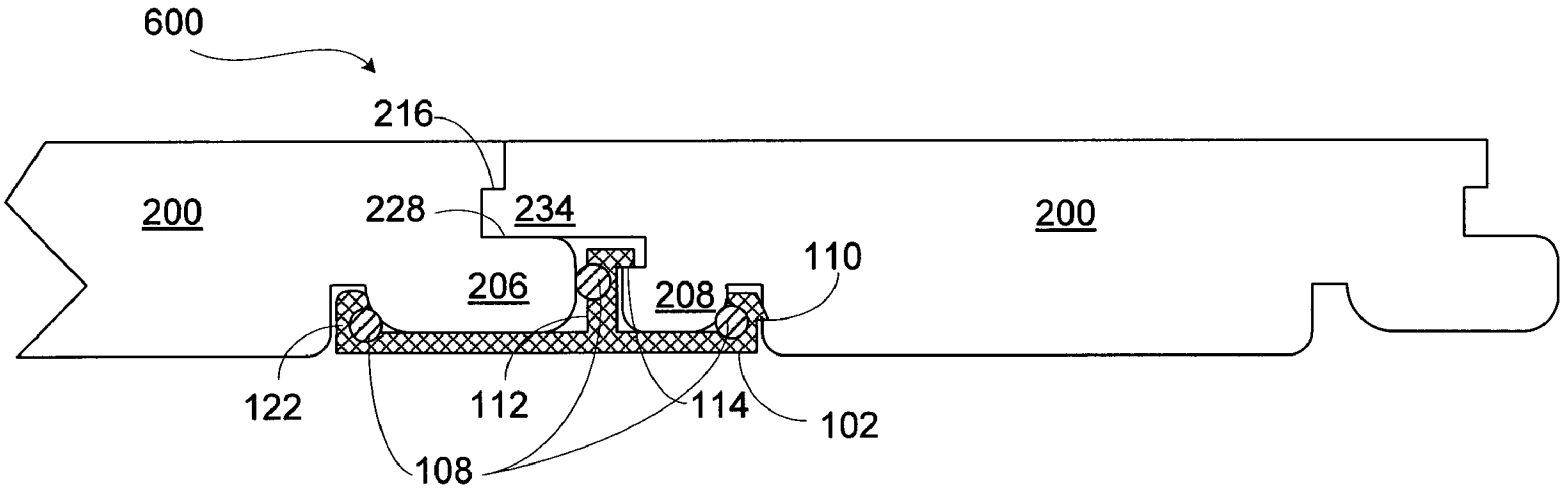
FIG. 6A illustrates two floor boards after being joined using a locking device.
Figure 6B:
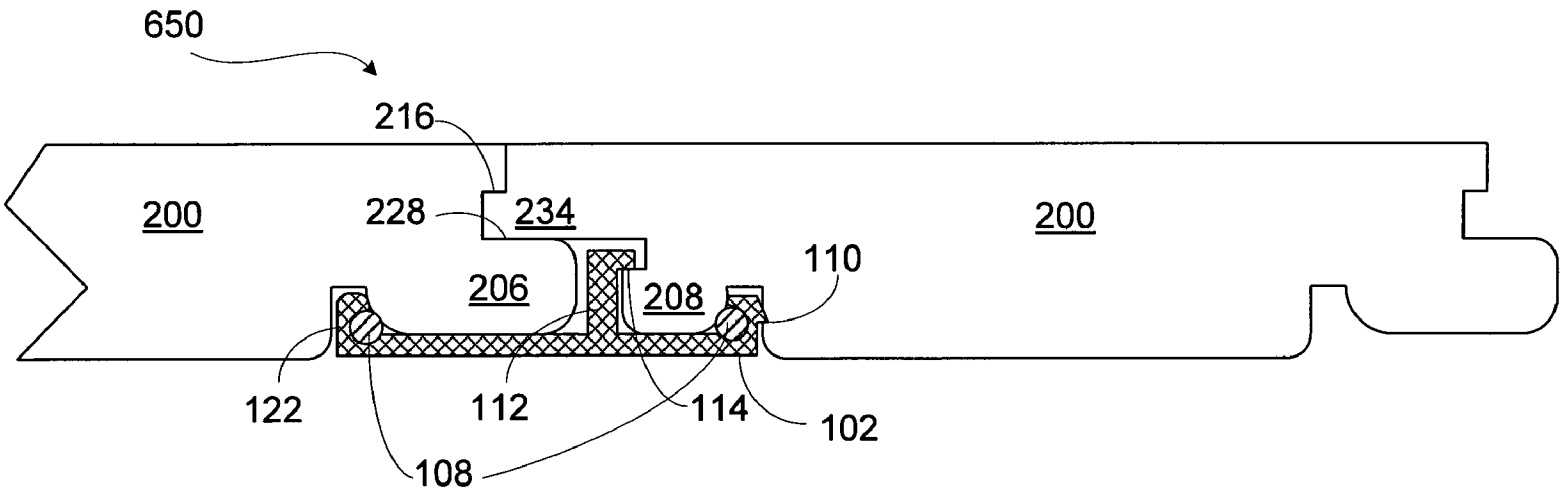
FIG. 6B depicts two floor boards in a joined position using an alternative locking device.
Figure 6C:
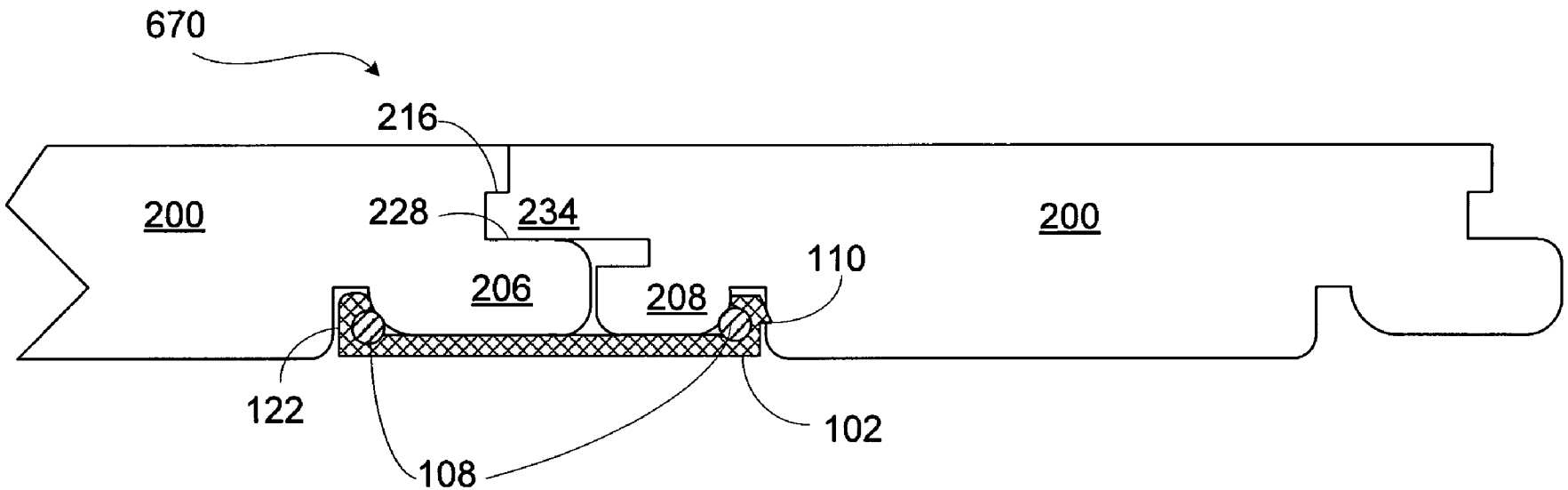
FIG. 6C depicts two floor boards in a joined position using yet an alternative locking device.

FIG. 6A depicts two adjacent floor boards 200 after being assembled together. The two adjacent floor boards 200 are locked in place by engagement of the tongue 234 of one floor board into the locking groove 240 of another floor board along the entire length of two floor boards 200. The two adjacent floor boards 200 are also locked in place by placement of the tongue 206. The tongue 206 is secured in place by the lower abutment surface 228 of the tongue 234 and the base 102 of the locking device 100. The tongue 206 is also secured by compression against the flexible buffer 108 on the first protruding gripping extension 122 and the flexible buffer 108 on the third protruding gripping extension 112. Because of use of two tongues 234, 206 and the compression of flexible buffers 108, two adjacent floor boards 200 are tightly joined and thus reducing squeaking sound (noise produced by friction between adjacent floor boards). The squeaking sound is further reduced with use of flexible buffers 108.

Double locking provided by the tongue 206 and tongue 234 helps to lock firmly two adjacent floor boards 200 even each floor board 200 is slightly deformed. The deformation may be caused by many factors, among them, variation in moisture, temperature, milling variation, or wood interior stress. Because of the special nature of the design provided by the invention, the successful rate for locking tightly adjacent floor boards is greatly increased. The relative vertical moves between two adjacent floor boards 200 are reduced by the double lock nature of the present invention. The risk of unlocking after the installation is also greatly reduced. The gaps between the floor boards 200 resulting from shrinking or expansion of the floor boards 200 are reduced or eliminated because of a strong squeeze force provided by the double locking.

FIG. 6B illustrates joining of two floor boards 200 similar to what is shown by FIG. 6A except for the locking device 100. The locking device used in FIG. 6B does not have a flexible buffer 108 along the third protruding gripping extension 112. The tongue 206 is still secured in place by the lower abutment surface 228 of the tongue 234 and the base 102 of the locking device 100, but the tongue 206 is now secured only by compression against the flexible buffer 108 on the first protruding gripping extension 122. Even without a flexible buffer 108 on the third protruding gripping extension 112, this configuration still offers double locking provided by the tongue 206 and tongue 234, which results in a firm lock without squeaking sound even two floor boards 200 are slightly deformed.

FIG. 6C illustrates joining of two floor boards 200 using a locking device 100 that does not have a third protruding gripping extension 112. Two floor boards 200 are tightly joined by the double locking provided by the tongue 206 and tongue 234 and the double locking mechanism is secured by the first protruding gripping extension 122 and second protruding gripping extension 120. The third tongue 206 is inserted into a groove defined by the lower abutment surface 228 of the first tongue 234, the base 102 of the locking device 100, the first protruding gripping extension 122, and the third tongue 208 of an adjacent floor board 200. The dimensions of the tongues 206 and 208 used in this locking configuration may be different from the dimensions of the tongues 206 and 208 using in other locking configurations. Optionally, glue may be used on the bottom side of the tongue 208 to stabilize the locking device 100.

Figure 7:
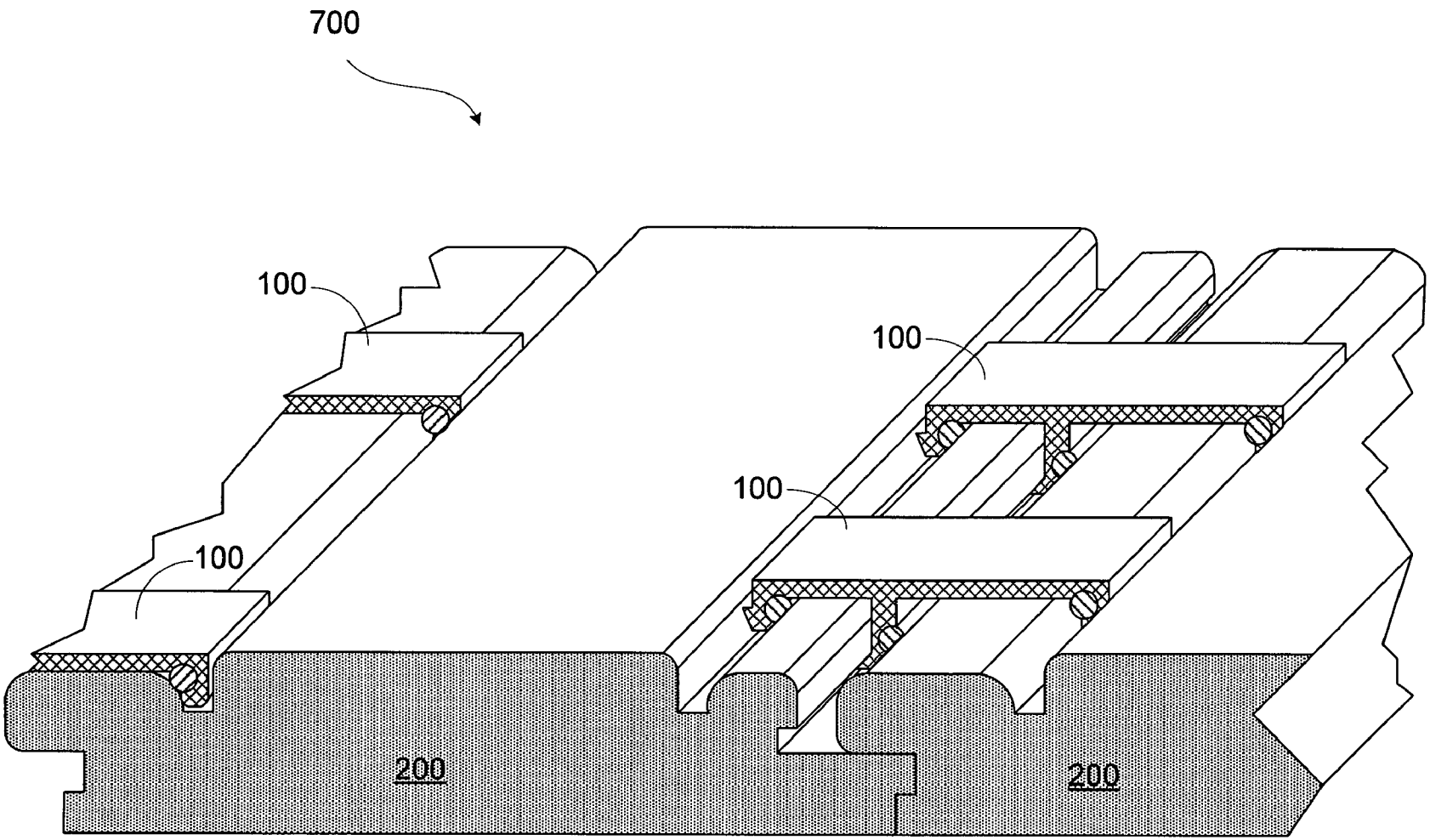
FIG. 7 depicts a perspective view from the bottom of two floor boards joined with a locking device.

FIG. 7 is an illustration 700 of two joined floor boards 200 with upside down view. As it can be seen, two adjacent floor boards 200 can be joined using few locking devices 100. There is no need to use long locking devices that cover the entire length of a floor board; thus the quantity of locking devices 100 used in a job site can be reduced.

The present invention makes easy on-site installation of floor boards 200 with use of locking devices 100. The locking devices 100 can be produced cheaply in large scale, assembled with flexible buffer 108, and pre-installed on each floor board 200. There is no need to use additional fixing devices, such as nails or screws. Each locking device 100 can be cut short for easy handling. The installation shown in FIGS. 6A and 6B can be reversed if needed. If an installer made a mistake during the installation, he can simply remove the floor board 200 that was installed in error and re-install it without damaging the locking device 100 or the floor boards 200.

Though the invention is described above using floor boards 200 as examples, the invention can be easily applied to other uses, such as wall panels, external sidings, roof panels, and ceiling panels. The locking device 100 can be used with boards and panels of different materials, such as laminate panels, plastic panels, cement panels, steel panels, etc.

The terms and expressions which have been employed herein are used as terms of description and not of limitation, and there is no intention, in the use of such terms and expressions, of excluding any equivalents of the features shown and described (or portions thereof), and it is recognized that various modifications are possible within the scope of the claims. Other modifications, variations, and alternatives are also possible. Accordingly, the claims are intended to cover all such equivalents. Dimensions in the drawings here presented are not to the scale unless otherwise indicated.

What is claimed is:

1. A locking device for floor boards, comprising:

a base having a first end and a second end;

a first protruding gripping extension located at the first end of the base;

a second protruding gripping extension located at the second end of the base; and a third protruding gripping extension located between the first and second gripping extensions, wherein the first protruding gripping extension further having a first receiving groove and a first buffer removably inserted in the first receiving groove and facing the third protruding gripping extension, and the second protruding gripping extension having a first side facing the third protruding gripping extension and a second side opposite of the first side, the second protruding gripping extension further having a second receiving groove on the first side and a second buffer removably inserted in the second receiving groove, the second side having a tooth.

2. The locking device of claim 1, wherein the third protruding gripping extension further comprising a horizontal platform mounted on top of the third protruding gripping extension, the horizontal platform having a top surface and a lower abutment surface.

3. The locking device of claim 1, wherein the third protruding gripping extension further having a third receiving groove and a third buffer removably inserted in the third receiving groove and facing the first protruding gripping extension.

4. The locking device of claim 1, wherein the locking device being made from a first flexible material.

5. The locking device of claim 4, wherein the first flexible material being aluminum.

6. The locking device of claim 4, wherein the first flexible material being plastic.

7. The locking device of claim 4, wherein the first flexible material being rubber.

8. The locking device of claim 4, wherein the first flexible material being steel.

9. The locking device of claim 3, wherein the first buffer, second buffer, and third buffer being made from a second flexible material.

10. The locking device of claim 9, wherein the second flexible material being rubber.

* * * * *